US011852399B2

(12) United States Patent
Wittes et al.

(10) Patent No.: US 11,852,399 B2
(45) Date of Patent: Dec. 26, 2023

(54) UPPER PLINTH OR TOP PANEL COVER FOR DOMESTIC APPLIANCE

(71) Applicants: BSH Home Appliances Corporation, Irvine, CA (US); BSH Hausgeräte GmbH, Munich (DE)

(72) Inventors: Joshua Wittes, Oak Ridge, TN (US); Ashish Modi, Istanbul (TR); Samuel Harward, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 116 days.

(21) Appl. No.: 17/521,912

(22) Filed: Nov. 9, 2021

(65) Prior Publication Data

US 2023/0144224 A1 May 11, 2023

(51) Int. Cl.
*F25D 23/02* (2006.01)
*A47B 95/00* (2006.01)

(52) U.S. Cl.
CPC ..... *F25D 23/028* (2013.01); *A47B 95/002* (2013.01); *F25D 2323/021* (2013.01); *F25D 2323/024* (2013.01)

(58) Field of Classification Search
None
See application file for complete search history.

(56) References Cited

U.S. PATENT DOCUMENTS 4,324,035 A 4/1982 Sherer
4,534,530 A * 8/1985 Danko ..... F16B 21/088 248/239
4,840,285 A 6/1989 Carr
4,970,874 A * 11/1990 Solak ..... F25D 23/10 312/236
5,971,510 A 10/1999 Lickiss
7,735,943 B2 * 6/2010 Hottmann ..... E05F 1/1261 312/401
7,871,300 B2 1/2011 McCoy
8,549,872 B2 * 10/2013 Kwon ..... F25D 25/024 312/271
11,035,163 B2 6/2021 Braden
11,624,548 B2 * 4/2023 Jang ..... F25D 23/028 312/401

(Continued)

FOREIGN PATENT DOCUMENTS

DE 102005057150 A1 * 6/2007 ..... F25D 23/062
WO WO-0214760 A1 * 2/2002 ..... F25D 23/025
WO WO-2006120063 A1 * 11/2006 ..... E05C 17/36

*Primary Examiner* — Hanh V Tran

(74) *Attorney, Agent, or Firm* — Michael E. Tschupp; Andre Pallapies; Brandon G. Braun

(57) ABSTRACT

A removable upper plinth or top panel structure for a domestic appliance, includes: an elongated plate-shaped cover for covering an access opening at a top portion of the domestic appliance; a plurality of attachment members disposed on the elongated plate-shaped cover for detachably mounting the elongated plate-shaped cover to the domestic appliance; and a plurality of tethers connected to the elongated plate-shaped cover, such that on condition that the elongated plate-shaped cover is detached from the domestic appliance to expose the access area, the elongated plate-shaped cover flips downward and hangs on the plurality of tethers.

20 Claims, 12 Drawing Sheets

(56) References Cited

U.S. PATENT DOCUMENTS

| | | | | |
|---|---|---|---|---|
| 2004/0189164 | A1* | 9/2004 | Hwang | F25D 23/00 312/401 |
| 2005/0217308 | A1* | 10/2005 | Hwang | F25D 23/028 62/298 |
| 2005/0218766 | A1* | 10/2005 | Hwang | F25D 23/10 312/405 |
| 2008/0036348 | A1* | 2/2008 | Carden | F25D 23/00 312/401 |
| 2008/0203874 | A1* | 8/2008 | Lim | F25D 23/02 312/404 |
| 2009/0033189 | A1* | 2/2009 | Glanz | F25D 23/028 49/31 |
| 2009/0284116 | A1* | 11/2009 | Gorz | F25D 23/062 312/405 |
| 2011/0101836 | A1* | 5/2011 | Gamble | A47B 95/002 312/293.3 |
| 2017/0191736 | A1* | 7/2017 | Fleig | F25D 23/028 |
| 2018/0031302 | A1* | 2/2018 | Park | E05D 11/0054 |
| 2018/0149413 | A1* | 5/2018 | Cakirca | F25D 29/005 |
| 2018/0274849 | A1* | 9/2018 | Chen | F25D 23/06 |
| 2019/0214802 | A1* | 7/2019 | Lindel | H02G 3/0418 |
| 2020/0115945 | A1* | 4/2020 | Akca | F16F 9/285 |
| 2020/0124338 | A1* | 4/2020 | Choi | F25D 17/062 |
| 2020/0284503 | A1* | 9/2020 | Gerstmayr | F25D 23/028 |
| 2020/0292227 | A1* | 9/2020 | Thayyullathil | B23P 15/26 |
| 2021/0333041 | A1* | 10/2021 | Pathapati | E05D 3/18 |
| 2022/0333847 | A1* | 10/2022 | Yoo | F25D 29/005 |

* cited by examiner

UPPER PLINTH OR TOP PANEL COVER FOR DOMESTIC APPLIANCE

FIELD OF THE INVENTION

The present disclosure relates generally to domestic or household appliances and, more particularly, to an upper plinth or top panel structure for a domestic appliance.

The present disclosure further relates to a removable upper plinth or top panel cover for a domestic appliance such as, for example, a refrigerator appliance or other similar home appliances. The upper plinth or top panel cover is removable in that it can be detached from the top of the appliance without being completely separated from the appliance. The upper plinth or top panel cover for a domestic appliance is for hiding parts while at the same time permitting easy accessibility by a service technician to install parts or perform service on parts that are normally hidden behind the upper plinth or top panel cover.

BACKGROUND OF THE INVENTION

Removable control consoles for appliances like washers and dryers and toe kick plates for appliances like refrigerators and dishwashers are known. However, these removable parts either have to be completely separated from the appliance, pivoted upward and back so as to rest at the rear of the appliance, or are located near the floor.

Also, it is generally the practice with appliances to either build distinct left and right Stock Keeping Units (SKU's) which are not reversible in the field, or to have distinct left and right plastic molded parts which must be swapped for left or right hand doors in appliances such as refrigerators.

SUMMARY OF THE INVENTION

The present disclosure provides an upper plinth or top panel cover for a domestic appliance that is configured for hiding parts while at the same time permitting easy accessibility by a service technician to install parts or perform service on parts that are normally hidden behind the upper plinth or top panel cover.

The present disclosure provides an upper plinth or top panel cover for a domestic appliance that is removable in that it can be detached from the top of the appliance without being completely separated from the appliance.

Consistent with the present disclosure, in a French door-bottom mount style refrigerator with two upper doors, the upper plinth or top panel cover is flipped down, for example, between approximately 90 and 180 degrees to expose and allow access to an area of the appliance housing above the front frame and hangs on ties or tethers.

Consistent with the present disclosure, in a single door refrigerator design, the upper plinth or top panel structure is reversible for left or right hand doors by providing an upper plinth which can be turned upside down to complete the reversal.

The present disclosure also provides an upper plinth or top panel structure that overlaps the front frame so that a gap having difficult-to-control tolerances is not visible. The inventors were able to provide a solution to a difficult geometry issue, so that the upper plinth or top panel structure is still reversible and has the same overlap regardless of which orientation in which it is mounted. This was accomplished by moving the center line of the mounting clips (or jaws and pins) on the hinge boxes a few millimeters (mm) lower than the center line of the space which the plinth fills above the appliance.

According to one aspect, the present disclosure provides a removable upper plinth or top panel structure for a domestic appliance, comprising: an elongated plate-shaped cover for covering an access area at a top portion of the domestic appliance; a plurality of attachment members disposed on the elongated plate-shaped cover for detachably mounting various components to the elongated plate-shaped cover and for detachably securing the elongated plate-shaped cover to the domestic appliance; and a plurality of tethers connected to the domestic appliance and also connected to the elongated plate-shaped cover, such that on condition that the elongated plate-shaped cover is detached from the domestic appliance to expose the access area, the elongated plate-shaped cover flips downward and hangs on the plurality of tethers.

According to another aspect, the plurality of attachment members includes at least one clip that extends from a location on a rear surface of the elongated plate-shaped cover.

According to another aspect, the at least one clip includes a pair of gussets at a base portion thereof.

According to another aspect, the plurality of attachment members includes a center clip on the back of the elongated plate-shaped cover and that attaches to a mounting part adapted to be mounted to the top portion of the domestic appliance.

According to another aspect, the plurality of attachment members includes a center clip and left and right side clips on the back of the elongated plate-shaped cover.

According to another aspect, the plurality of attachment members includes upper and lower gripping jaws on the right and left sides on a rear surface of the elongated plate-shaped cover and which slide over and grip corresponding posts that extend from right and left hinge boxes of the domestic appliance.

According to another aspect, the upper and lower gripping jaws on the right and left sides on the rear surface of the elongated plate-shaped cover allow for axial sliding movement on the posts in a left and right direction of the elongated plate-shaped cover to allow for proper alignment.

According to another aspect, a lower edge of the elongated plate-shaped cover overlaps a front frame of the domestic appliance.

According to another aspect, the elongated plate-shaped cover includes an opening for a power switch, an opening for an open door assistant, and a smaller opening for an ambient light sensor. Bottom mount appliances (with a single refrigerator compartment door) have the open door assistant at the center of the appliance, so that the hole for the open door assistant is aligned regardless of whether the upper plinth is assembled in the left hinge or right hinge configuration.

According to another aspect, the present disclosure provides a removable upper plinth or top panel structure for a domestic appliance, comprising: an elongated plate-shaped cover for covering an access area at a top portion of the domestic appliance; a plurality of attachment members disposed on the elongated plate-shaped cover for detachably mounting various components to the elongated plate-shaped cover and for detachably securing the elongated plate-shaped cover to the domestic appliance; and a single tether to keep the elongated plate-shaped cover from swinging down uncontrollably on one side on condition that the elongated plate-shaped cover is detached from the domestic appliance.

According to another aspect, the single tether can be twisted 180 degrees to allow the elongated plate-shaped cover to be turned upside down and assembled in an alternate orientation.

According to another aspect, the present disclosure provides a domestic appliance, comprising: an outer casing forming a housing; a front frame disposed on a front portion of the housing; at least one door mounted to the front portion of the housing; and a removable upper plinth or top panel structure disposed above the front frame on the domestic appliance, the removable upper plinth or top panel structure comprising: an elongated plate-shaped cover for covering an access area above the front frame of the domestic appliance; a plurality of attachment members disposed on the elongated plate-shaped cover to detachably mount various components to the elongated plate-shaped cover and for detachably securing the elongated plate-shaped cover to the domestic appliance; and at least one tether connected to the domestic appliance and also connected to the elongated plate-shaped cover, such that on condition that the elongated plate-shaped cover is detached from the domestic appliance to expose the access area, the elongated plate-shaped cover is tethered to the domestic appliance by the at least one tether.

According to another aspect, the domestic appliance comprises a French door bottom mount configuration having an upper fresh food compartment with the at least one door comprising two doors and a bottom freezer compartment.

According to another aspect, the domestic appliance comprises a single door bottom mount configuration having an upper fresh food compartment with the at least one door comprising a single door and a bottom freezer compartment.

According to another aspect, the at least one tether comprises a single tether to keep the elongated plate-shaped cover from swinging down uncontrollably on one side on condition that the elongated plate-shaped cover is detached from the domestic appliance.

According to another aspect, the at least one tether comprises a plurality of tethers connected to the domestic appliance and also connected to the elongated plate-shaped cover, such that on condition that the elongated plate-shaped cover is detached from the domestic appliance to expose the access area, the elongated plate-shaped cover flips downward and hangs on the plurality of tethers.

According to another aspect, the present disclosure provides a removable upper plinth for a domestic appliance, comprising: an elongated plate-shaped cover for covering an access area at a top portion of the domestic appliance; a plurality of attachment members disposed on the elongated plate-shaped cover for detachably securing the elongated plate-shaped cover to the domestic appliance; and at least one tether connected to the domestic appliance and also connected to the elongated plate-shaped cover, such that on condition that the elongated plate-shaped cover is detached from the domestic appliance to expose the access area, the elongated plate-shaped cover is tethered to the domestic appliance by the at least one tether.

According to another aspect, the at least one tether comprises a single tether to keep the elongated plate-shaped cover from swinging down uncontrollably on one side condition that the elongated plate-shaped cover is detached from the domestic appliance.

According to another aspect, the at least one tether comprises a plurality of tethers connected to the domestic appliance and also connected to the elongated plate-shaped cover, such that on condition that the elongated plate-shaped cover is detached from the domestic appliance to expose the access area, the elongated plate-shaped cover flips downward and hangs on the plurality of tethers.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 2A:
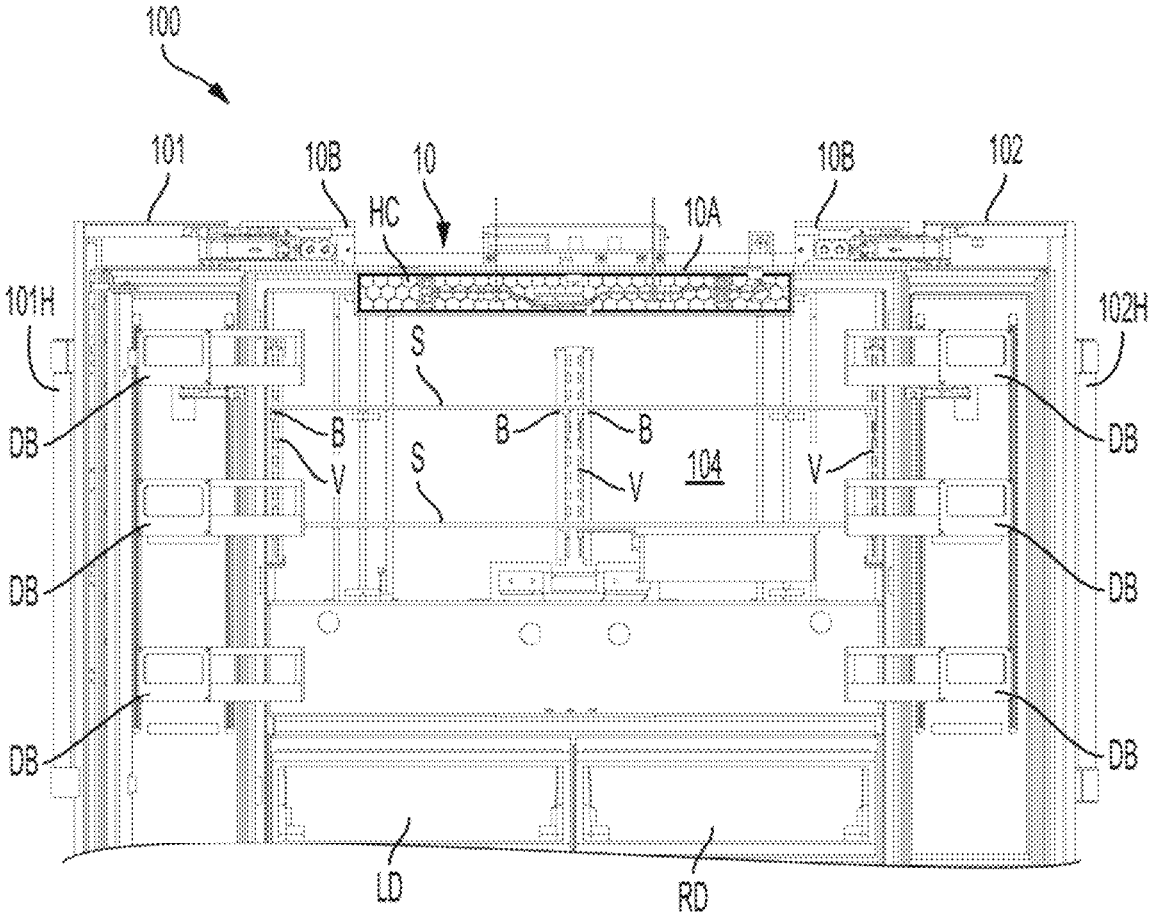
FIG. 2A is a partial front view showing the upper portion of a French door-bottom mount style refrigerator similar to FIG. 1, but showing the upper plinth or top panel cover flipped down 180 degrees to expose and allow access to an area of the appliance housing above the front frame according to an exemplary embodiment consistent with the present disclosure.
Figure 2B:
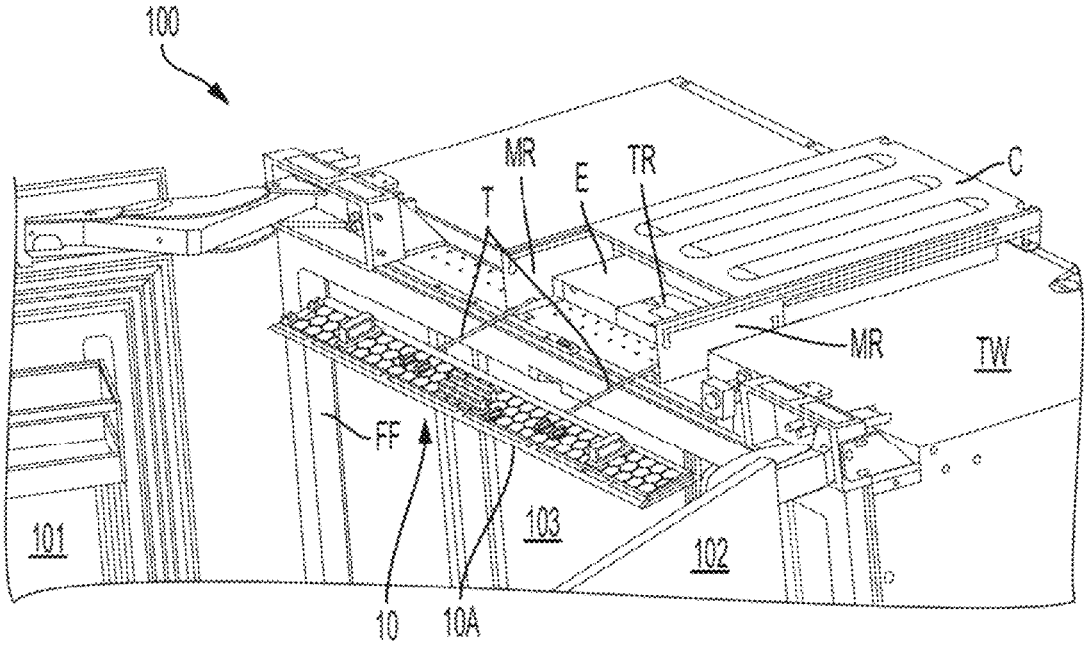
Figure 2C:
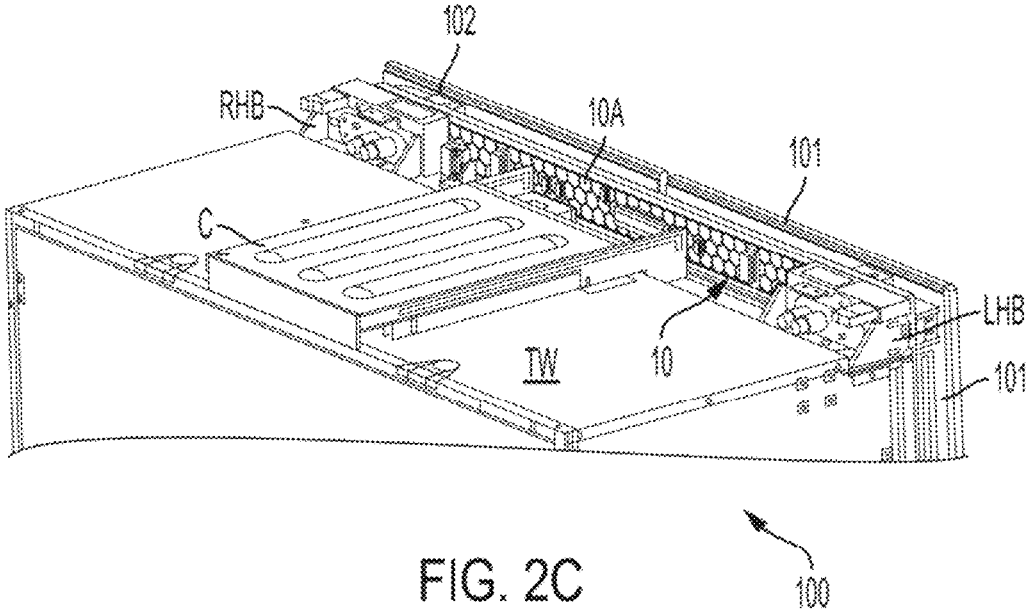
Figure 3:
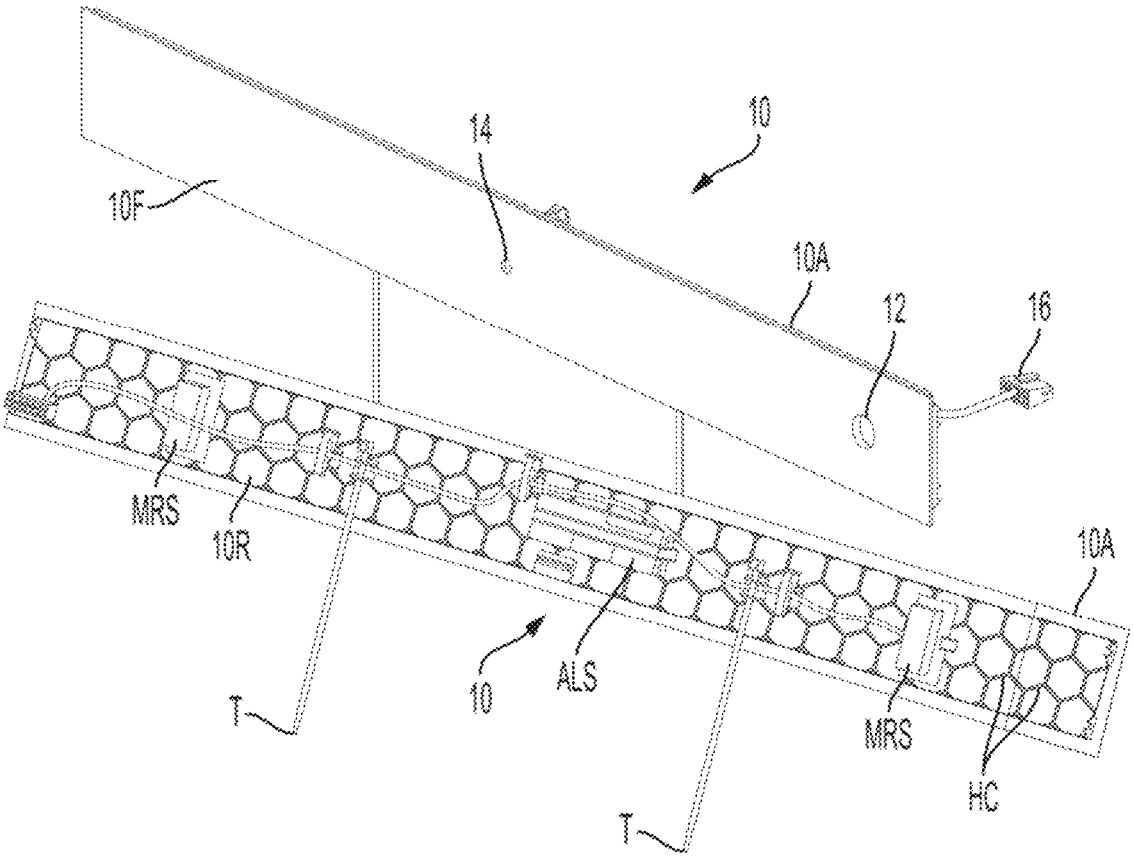
Figure 4:
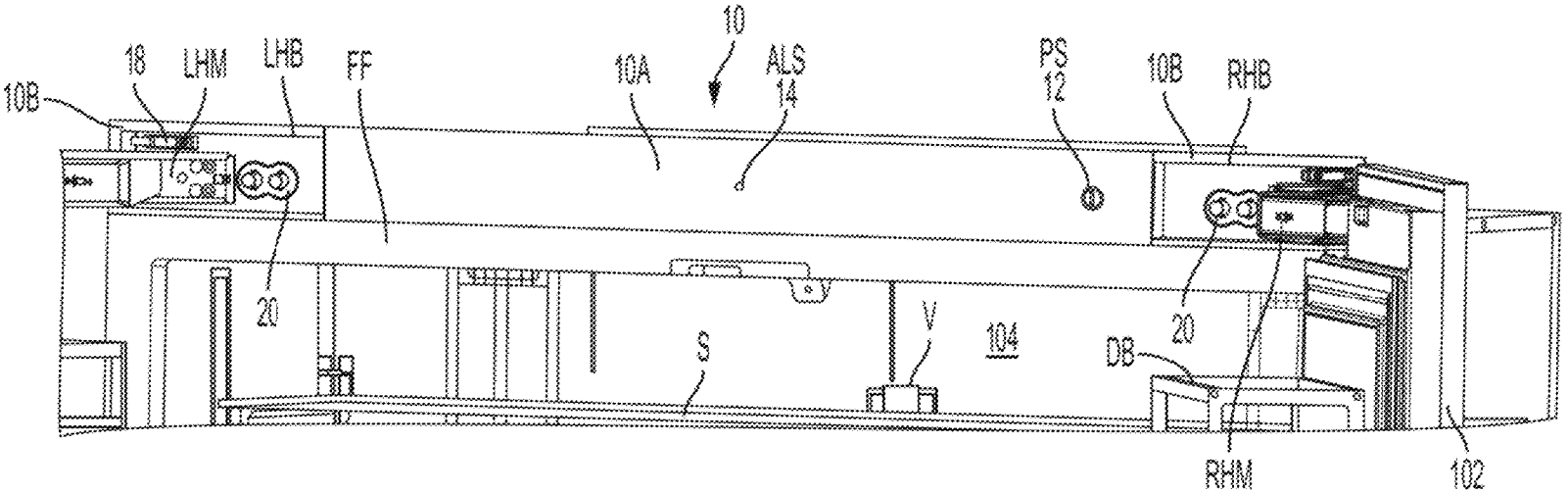
Figure 5A:
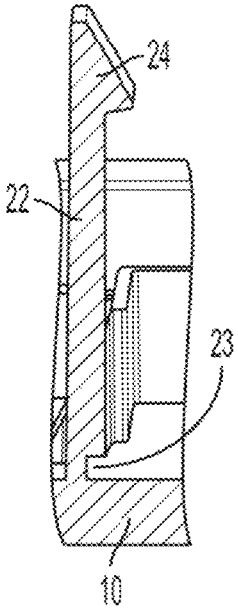
Figure 5B:
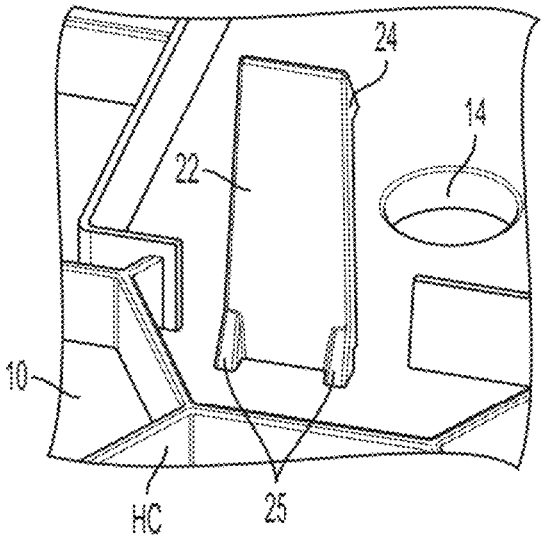
Figure 6A:
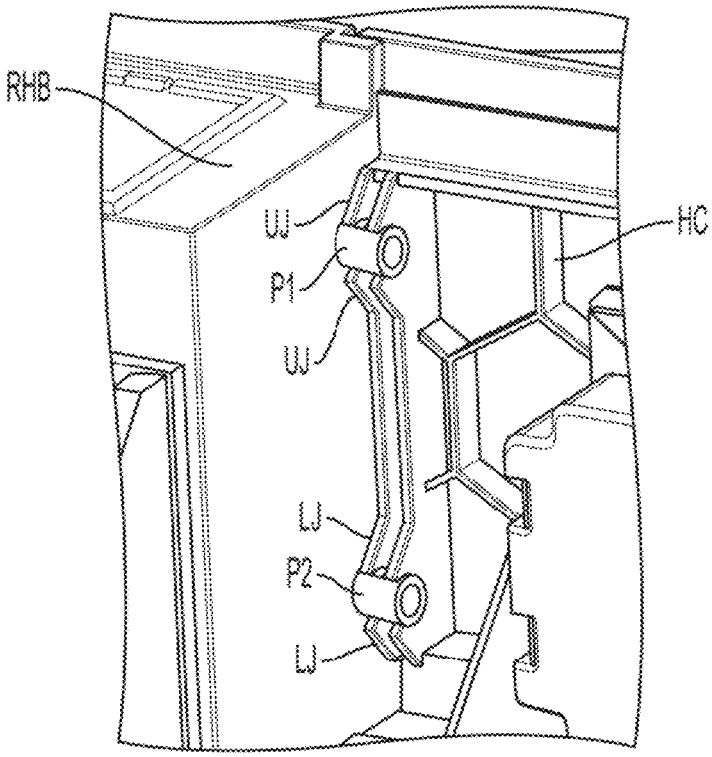
Figure 6B:
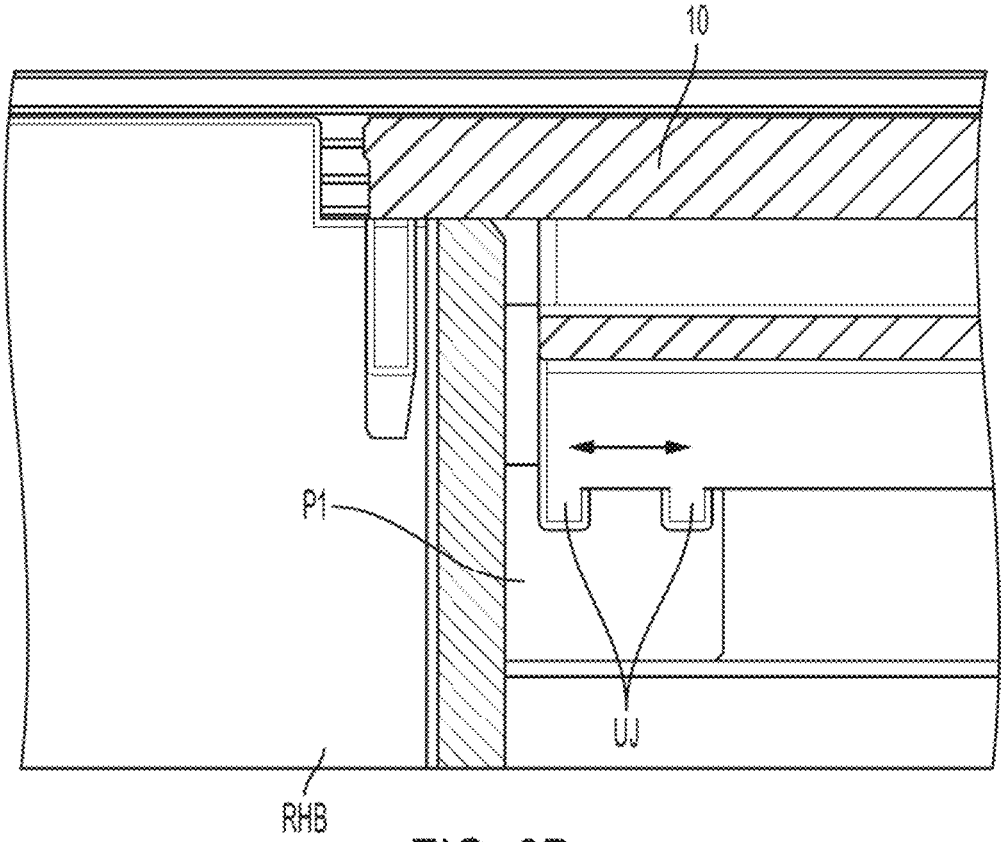
Figure 7B:
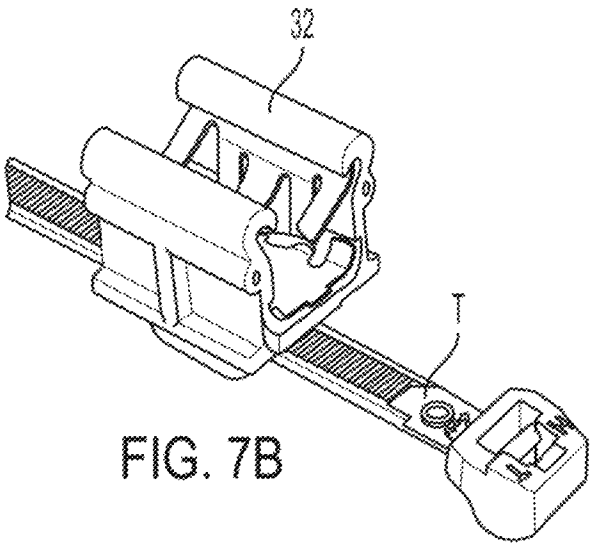
Figure 7A:
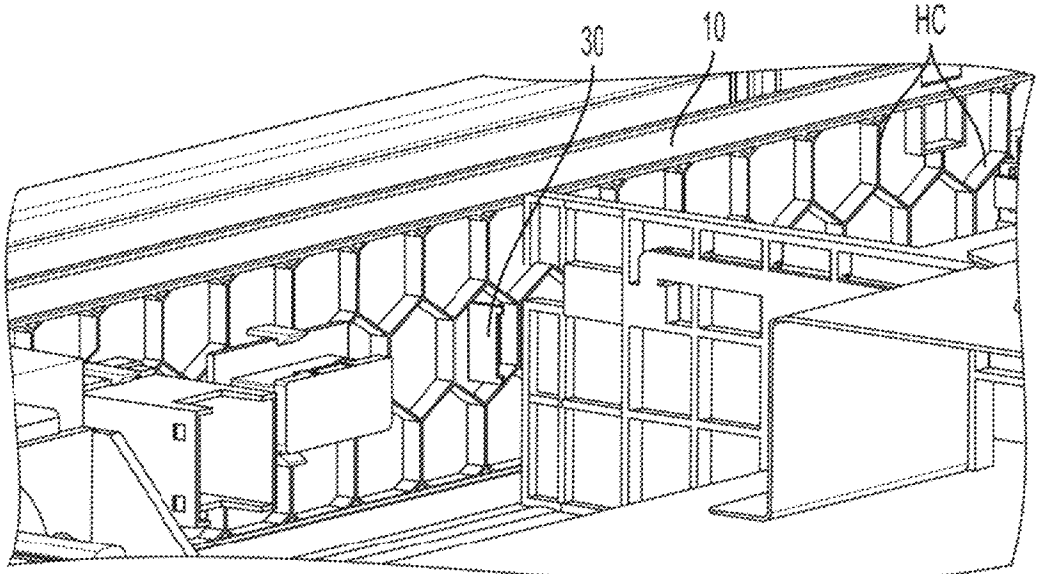
Figure 7C:
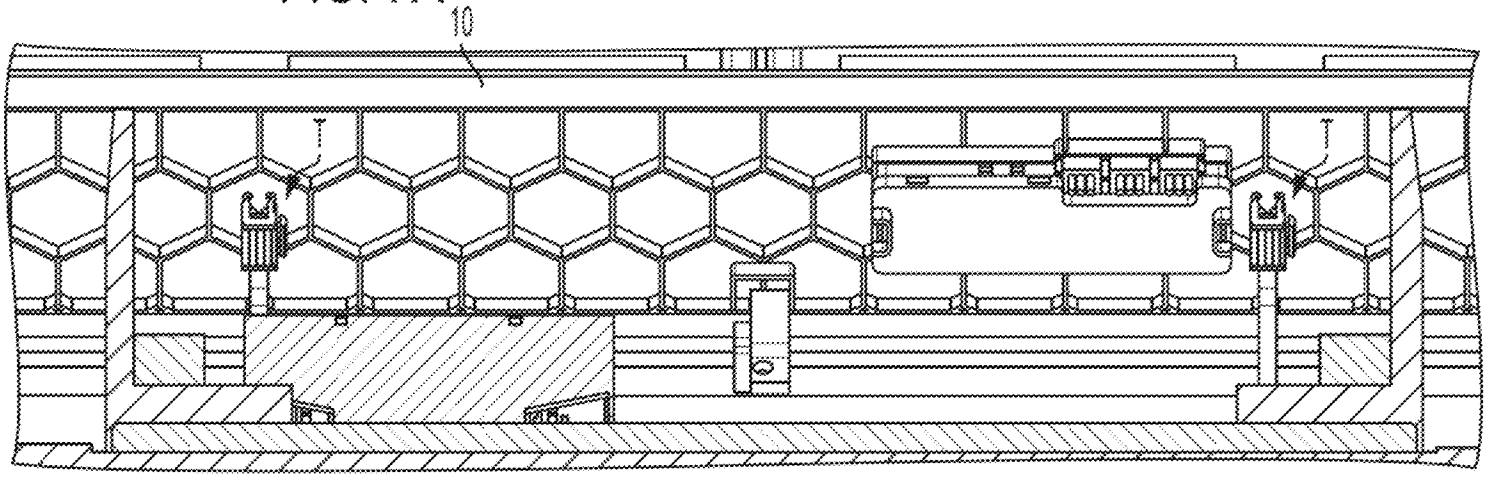
Figure 8:
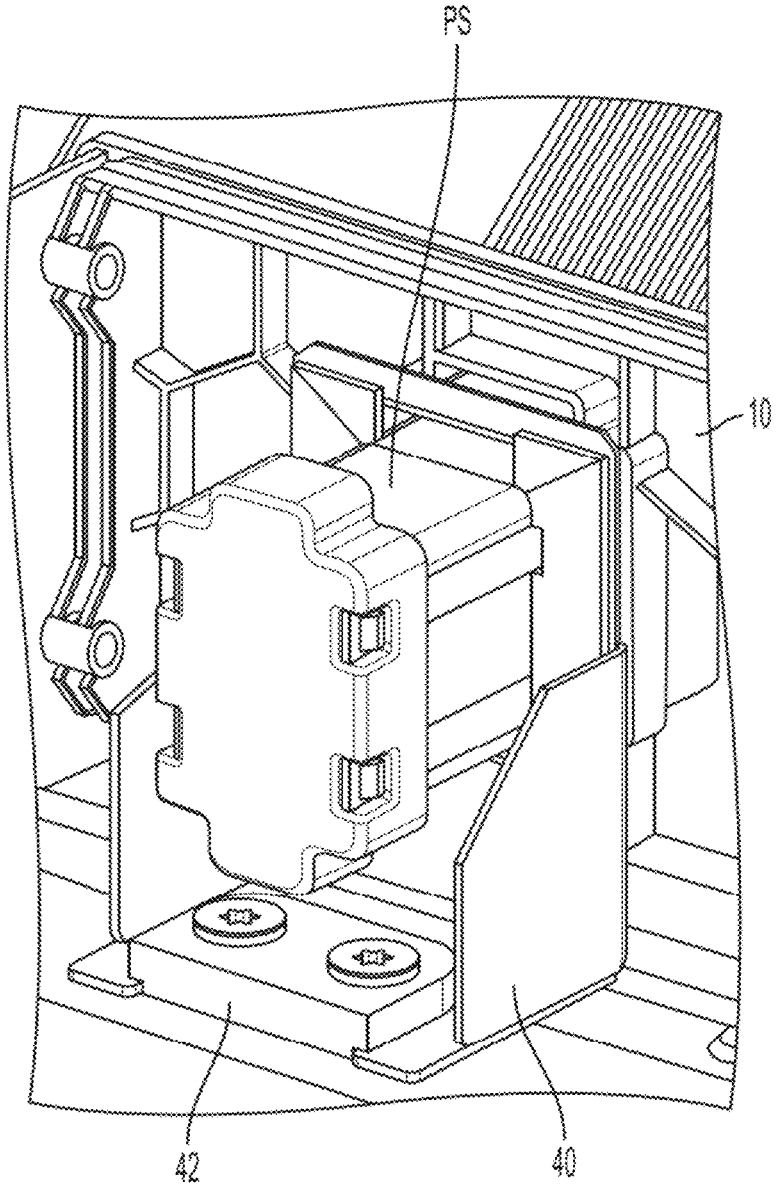
Figure 9A:
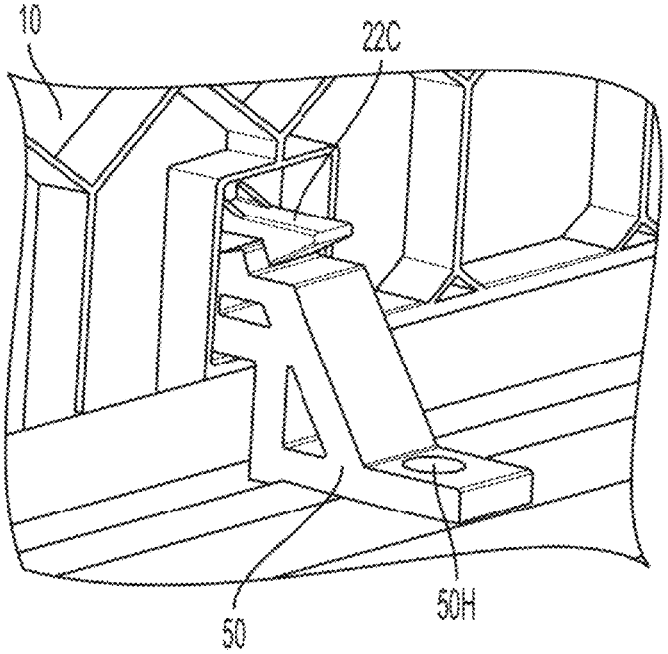
Figure 9B:
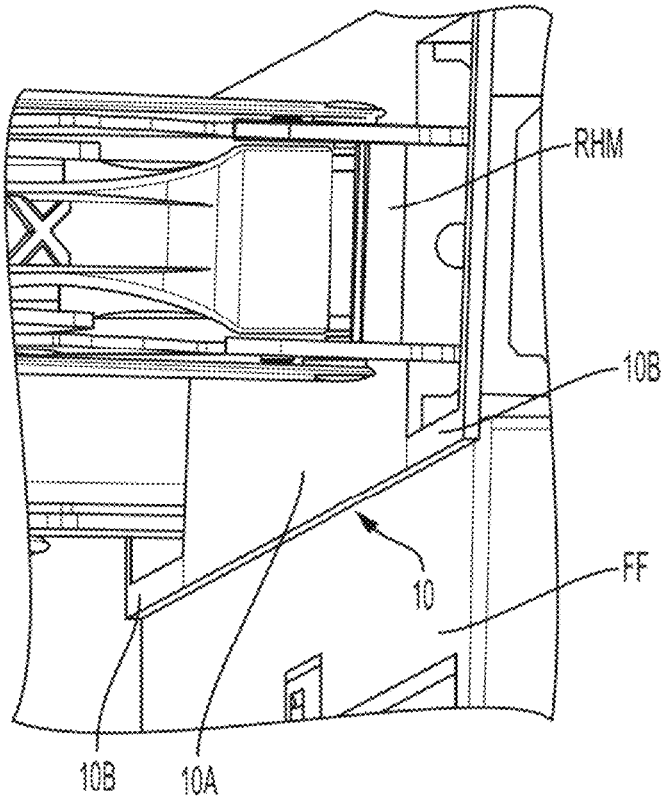
Figure 10:
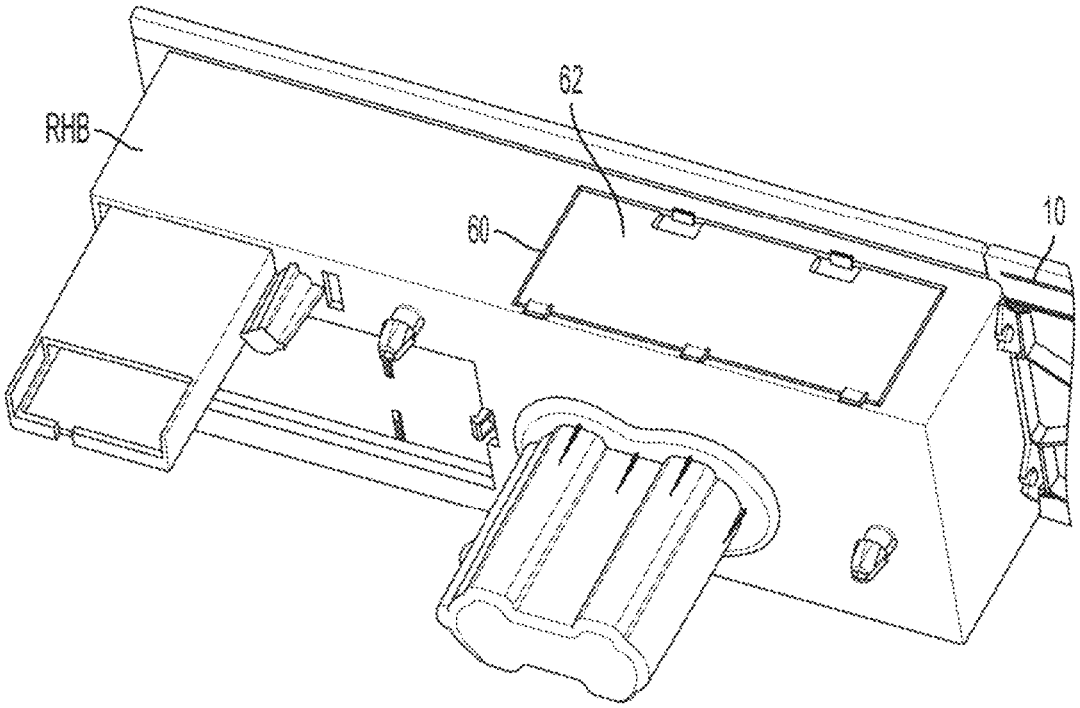
Figure 11A:
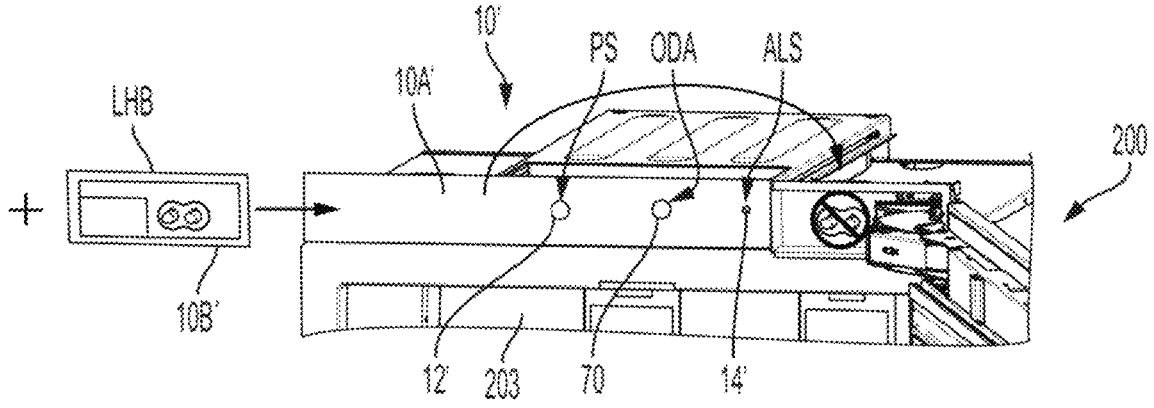
Figure 11B:
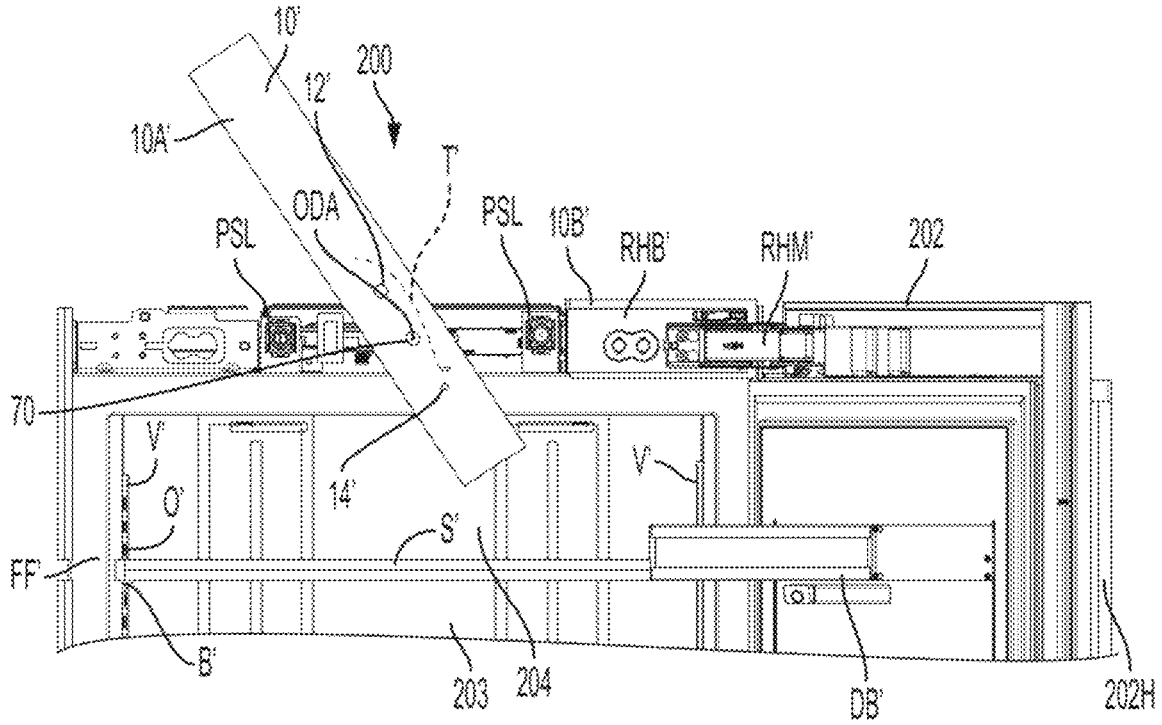

FIGS. 2B and 2C are perspective views from the top front and top rear, respectively, of the French door-bottom mount style refrigerator, with FIG. 2B showing the upper plinth or top panel cover flipped down about 90 degrees to expose and allow access to an area of the appliance housing above the front frame and FIG. 2C showing the upper plinth or top panel cover from the rear in its upright and normal position according to an exemplary embodiment consistent with the present disclosure;

FIG. 3 are isolated perspective views of the front and rear of the upper plinth or top panel cover according to an exemplary embodiment consistent with the present disclosure;

FIG. 4 is an enlarged front view showing the upper plinth or top panel cover on a French door-bottom mount style refrigerator according to an exemplary embodiment consistent with the present disclosure;

FIGS. 5A and 5B are side view and perspective view, respectively, of one of the clips used for attaching the upper plinth or top panel cover to the housing of the appliance or attaching various components according to an exemplary embodiment consistent with the present disclosure;

FIGS. 6A and 6B are views showing a connection configuration for attaching the upper plinth or top panel cover to the housing of the appliance according to an exemplary embodiment consistent with the present disclosure;

FIGS. 7A, 7B, and 7C are various views of the upper plinth or top panel cover, with FIGS. 7A and 7C showing a back of the upper plinth or top panel cover and FIG. 7B showing one of, for example, two wire ties or tethers that clip on the back surface of the upper plinth or top panel cover according to an exemplary embodiment consistent with the present disclosure;

FIG. 8 is an enlarged view of the power switch and power switch bracket which mounts to the appliance according to an exemplary embodiment consistent with the present disclosure;

FIGS. 9A and 9B are views showing a center clip on the back of the upper plinth or top panel cover that attaches to a mounting part mounted to the cabinet or housing of the appliance, and a lower edge of the upper plinth or top panel cover overlapping the front frame of the appliance, respectively, according to an exemplary embodiment consistent with the present disclosure;

FIG. 10 is a top, rear perspective view of the right hinge box RHB having an access window that is covered by a plastic cover, according to an exemplary embodiment consistent with the present disclosure; and FIGS. 11A and 11B show partial front views of another embodiment of the upper plinth or top panel cover which is configured to rotate 180 degrees about a center position for door reversibility with single door bottom mount appliances according to an exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
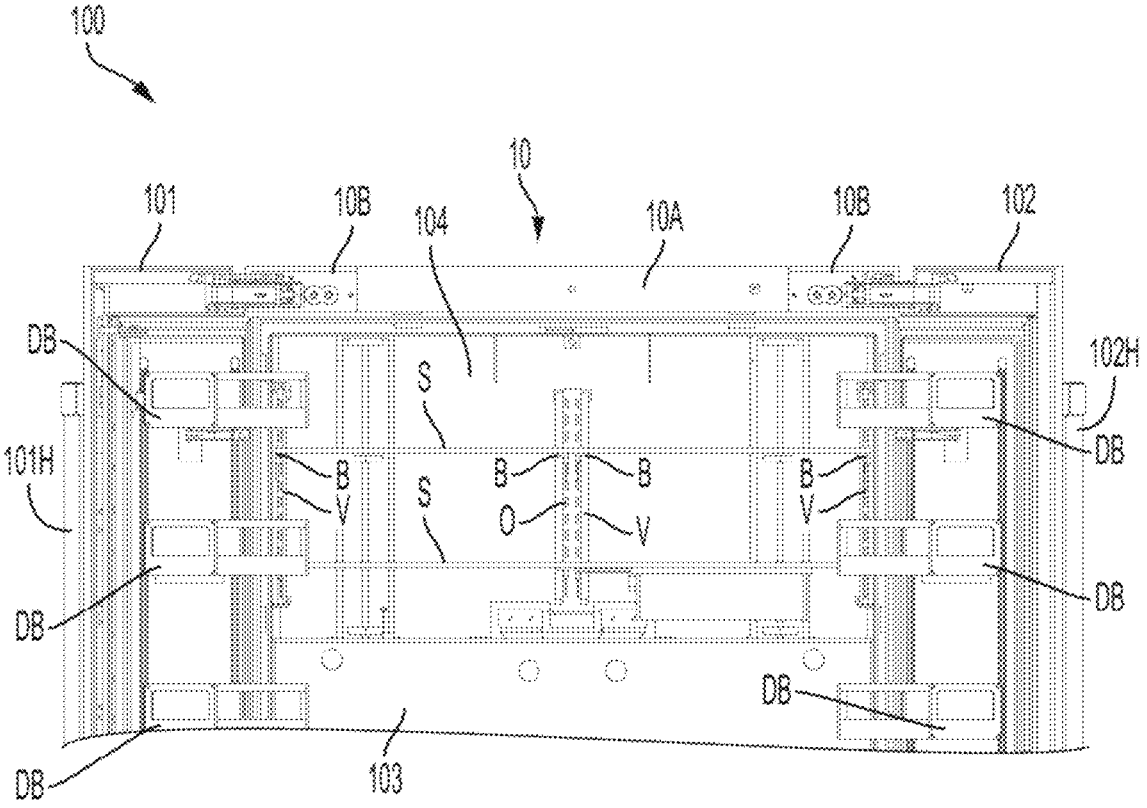
FIG. 1 is a partial front view showing the upper portion of a French door-bottom mount style refrigerator having two doors and an upper plinth or top panel cover according to an exemplary embodiment consistent with the present disclosure.

FIG. 1 shows the upper portion of a French door-bottom mount (FDBM) style refrigerator appliance 100 (also sometimes referred to as refrigerator 100 or simply appliance 100) includes an insulated body comprising as a foamed housing having two doors 101 and 102 for closing a fresh food compartment 103 (also referred to as a refrigerator compartment 103) and an upper plinth or top panel cover 10 according to an exemplary embodiment consistent with the present disclosure. As best shown in FIGS. 1, 2A, 2B, and 2C, the upper plinth or top panel cover 10 comprises an elongated plate-shaped cover 10A which is removable in that it can be detached from the top of the appliance 100 without being completely separated from the appliance 100. The upper plinth 10 can also include left and right stationary pieces 10B that cover or can be part of left and right hinge boxes LHB and RHB for an aesthetically pleasing appearance to the consumer when the doors 101, 102 are opened. The upper plinth or top panel cover 10 is an access cover for the main electronics E and some other components which are housed in a compartment C at the top wall TW of the appliance 100 (see FIGS. 2B and 2C). The upper plinth or top panel cover 10 can be removed and an electronics tray TR with the main electronics E can slide forward for service (see FIG. 2B). Thus, the top wall TW of the metal housing of the appliance 100 is near the bottom of the upper plinth or top panel cover 10, so that the upper plinth or top panel cover 10 covers a space or area above the metal housing of the appliance 100.

As shown in FIG. 1, each of the two doors 101 and 102 has a handle 101H and 102H, respectively. Of course, the doors 101 and 102 can also have a handle-less configuration. Although not shown in the figures, the FDBM style refrigerator 100 normally has a bottom freezer compartment which is accessed using a pull out drawer type of configuration. One or more middle or flexible type drawers that have an independently adjustable temperature can also be included between the top fresh food compartment 103 and the bottom freezer compartment (not shown). With reference to FIGS. 1 and 2A, the fresh food compartment 103 includes, for example, a number of shelves S, a lower left side drawer LD, a lower right side drawer RD, and door bins DB such as in the doors 101 and 102. The shelves S are supported by shelf support railings or shelf support brackets B that include hooks (not shown) at the rear for connection to and adjustment along vertical tracks V formed by separate metal strips having openings such as slots or holes O therein and arranged along a wall (e.g., a rear wall 104 of the refrigerator compartment 103). The fresh food or refrigerator compartment 103 is typically set in a range of 1° C. to 6° C., and the freezer compartment is typically set at −18° C. or colder.

FIG. 3 shows the front and rear of the removable, elongated plate-shaped cover upper 10A per se of the upper plinth or top panel cover 10 isolated from the refrigerator appliance 100. The upper part of FIG. 3 shows the front 10F of the elongated plate-shaped cover 10A. As shown in the upper part of FIG. 3, a larger opening 12 is provided for a power switch (described later) and a smaller opening 14 is provided for an ambient light sensor (described later). Also shown is a connector 16 to connect the electrical wiring to a power line (not shown). The lower part of FIG. 3 shows the elongated plate-shaped cover 10A of the upper plinth or top panel cover 10 flipped over to expose the back side or rear 10R thereof. As shown in the lower part of FIG. 3, a pair of ties or tethers T can be used to hang the removable, elongated plate-shaped cover 10A of the upper plinth or top panel cover 10 on the foamed housing or cabinet of the refrigerator appliance 100 according to an exemplary embodiment consistent with the present disclosure. For example, but not limited thereto, the tethers T can be connected to the metal rails MR for the electronics tray TR (see FIG. 2B) or to a clip (not shown) at the center of the top of the appliance 100. However, the tethers T can be connected to the top of the appliance 100 at any location, as long as they can serve to keep the upper plinth or top cover 10 from falling off or straining the attached wiring while service work is performed. Although a pair of ties or tethers T is shown, the number of ties or tethers T can be more or less. FIGS. 2A-2C, 3, and 5B show that the rear or back surface of the elongated plate-shaped cover 10A of the upper plinth or top panel cover 10 can have a honeycomb shaped reinforcing structure HC formed thereon to give added strength to the elongated plate-shaped cover 10A of the upper plinth or top panel cover 10. A pair of magnetic reed sensors MRS and an ambient light sensor ALS are also shown in FIG. 3.

FIG. 4 is an enlarged front view showing the upper plinth or top panel cover 10 in position on the top of the French door-bottom mount style refrigerator 100 as shown in FIGS. 1 and 2A-2C according to an exemplary embodiment consistent with the present disclosure. As shown in FIG. 4, a power switch PS is exposed through the larger opening 12 in the elongated plate-shaped cover 10A of the upper plinth or top panel cover 10 and an ambient light sensor ALS is exposed through the smaller opening 14 in the elongated plate-shaped cover 10A of the upper plinth or top panel cover 10. Also in view in FIG. 4 are the left hinge box LHB and the right hinge box RHB, with the removable, elongated plate-shaped cover 10A of the upper plinth or top panel cover 10 being disposed in between the two hinge boxes which can include the left and right stationary pieces 10B. Referring to the left hinge box LHB, a cable chain anchor 18 for routing wires safely around the hinge generally denoted as a left hinge mechanism LHM and a soft close damper 20 are shown. Also shown in FIG. 4 is the right hinge mechanism RHM and the front frame FF of the refrigerator 100. The upper plinth or top panel cover 10 is disposed above and slightly overlaps the top of the front frame FF as will be discussed in more detail below.

FIGS. 5A and 5B are side view and perspective view, respectively, of one of a plurality of attachment members in the form of a clip 22 used for either 1) attaching the removable, elongated plate-shaped cover 10A of the upper plinth or top panel cover 10 to the housing of the refrigerator appliance 100 according to an exemplary embodiment consistent with the present disclosure, or 2) attaching various components, electronics, and/or sensors to the back side of the upper plinth (for example, an ambient light sensor ALS, a magnetic reed sensor MRS for door open position, or the like). The elongated plate-shaped cover 10A of the upper plinth or top panel cover 10 will hereinafter be referred to simply as "the upper plinth 10" for ease of explanation unless otherwise indicated. As best shown in FIG. 5A, each of the clips 22 is formed of plastic and extends from a location, for example, near the lower rear surface of the upper plinth 10 at the left and right side portions thereof. Each plastic clip 22 is formed with an under-cut 23 at the bottom thereof to eliminate sink marks on the front of the upper plinth 10 which is visible to the user when the door(s) 101, 102 is/are open. Each clip 22 has a projection or pawl 24 on the end thereof to engage with the housing of the refrigerator appliance 100 or the attached component (for example, an ambient light sensor ALS, a magnetic reed sensor MRS for door open position) and affix the two together. As shown in FIG. 5B, the clip 22 includes a pair of gussets or buttresses 25 at a base portion thereof to prevent the plastic clip 22 from breaking. FIG. 5B shows one of the clips 22 just beside a large space that is provided for an ambient light sensor ALS. Preferably, but not necessarily, there are two plastic clips 22 for every component which will be attached, one at the side with no hinge on bottom mount appliances, and one at the bottom middle of the upper plinth 10. The center or middle clip is discussed in more detail below.

FIGS. 6A and 6B are views showing a preferred connection configuration for attaching the upper plinth 10 to the housing of the appliance according to an exemplary embodiment consistent with the present disclosure. In particular, FIG. 6A shows a pair of vertically spaced apart circular posts P1 and P2 which extend from the side wall of the right hinge box RHB. In the case of FIG. 6A, the right hinge box RHB is shown from the rear. A rear of the right side of the upper plinth 10 is shown in FIG. 6A with upper and lower gripping jaws UJ and LJ which slide over and grip the posts P1 and P2 with an interference fit, respectively. As shown in FIG. 6B, which shows a top of the right side of the upper plinth 10 from a rear point of view, the circular posts P1 and P2 (only the top post P1 being in view) permit the upper plinth 10 to undergo some axial sliding movement by the gripping jaws UJ and LJ along the posts P1 and P2 as indicated by the arrow. The posts P1 and P2 will allow for 0.6 mm of axial sliding movement of the gripping jaws UJ and LJ of the upper plinth 10 left and right for a total of 1.2 mm. This in turn allows for easier alignment of the open door assistant ODA and the power switch PS with the openings 70 and 12 in the upper plinth 10. Although not shown, the same configuration is used on the other side of the appliance with a pair of vertically spaced apart circular posts P1 and P2 extending from the side wall of the left hinge box LHB, and upper and lower gripping jaws UJ and LJ slid over and grip the posts P1 and P2, respectively. The circular posts P1 and P2 and gripping jaws UJ and LJ are one possible affixing method. They are preferred because they allow some side-to-side motion so that the plinth can be aligned with fixed features on the appliance (like open door assistant). Other fixation methods (such as standard clips 22) are also possible.

FIGS. 7A and 7C showing a back of the upper plinth 10 and FIG. 7B shows one of, for example, two wire ties or tethers T that clip on the back surface of the upper plinth 10 according to an exemplary embodiment consistent with the present disclosure. In particular, tabs 30 (one of which is shown in FIG. 7A) formed on the back of the upper plinth 10 serve as secure mounting points for an edge clip 32 for each wire tie or tether T. As noted above, the other ends of the tethers T can be connected to the metal rails for the electronics tray TR (see FIG. 2B) or to another part of the housing of the appliance 100. When the upper plinth 10 is unclipped or detached from the appliance 100 by detaching the upper and lower gripping jaws UJ and LJ or clips 22, the two wire ties or tethers T which can be formed of nylon wire, keep the upper plinth 10 attached or tethered to the appliance. Thus, the two wire ties or tethers T hold the upper plinth 10 so that a service technician does not have to hold the upper plinth 10 while working on the parts or in the area normally hidden by the upper plinth 10. The two wire ties or tethers T also serve as a strain relief to prevent damage to the wiring for various components at the back of the upper plinth 10 (ambient light sensor ALS, magnetic reed sensors MRS, etc.).

FIG. 8 is an enlarged view of the power switch PS and a power switch bracket 40 which mounts to the appliance according to an exemplary embodiment consistent with the present disclosure. The power switch bracket 40 provides a fixed mounting point for the power switch PS. In this way, the customer quality perception is improved because the power switch PS will not flex as it is pressed. Also, since the power switch PS is mounted to the power switch bracket 40, this facilitates servicing by a service technician, because the power switch PS does not stay attached to the rear of the upper plinth 10 when the upper plinth 10 is open for service. A pair of power switch anchors 42 (only one of which is shown in FIG. 8) are disposed on the left and right sides of the bottom mount or BM (refrigeration compartment has only one door) style refrigerator appliance 200 (see FIGS. 11A and 11B) for mounting the switch bracket 40 on either side. Thus, for door reversal with a single door configuration, the power switch PS and power switch bracket 40 can be moved from one side to the other and fixed to the appliance by the corresponding power switch anchor 42 (the door reversal with a single door configuration will be discussed in more detail below).

FIG. 9A shows a center or middle clip 22C on the back of the upper plinth 10 at the bottom middle thereof that attaches tightly to a mounting part 50 mounted to the cabinet or housing of the appliance 100 by a fastener (not visible) such as a screw or bolt or rivet through a hole 50H. The mounting part 50 can be formed of plastic or aluminum, can be, for example, extruded, injection molded, or machined and presses the center portion of the upper plinth 10 down to match any curvature occurring in the housing of the appliance 100. FIG. 9B shows a lower edge of the upper plinth 10 (the portions 10A and 10B) overlapping the front frame FF of the appliance 100 by, for example but not limited to, 5 mm. Because of this overlap, even if the housing of the appliance 100 is not perfectly flat, no uneven and unsightly gap between the front frame FF and the bottom of the upper plinth or top panel cover 10 is visible to the consumer.

FIG. 10 is a top, rear perspective view of the right hinge box RHB having an access window 60 that is covered by a plastic cover 62. An access window 60 that is covered by a plastic cover 62 is also formed in the left hinge box (not shown in FIG. 10) according to an exemplary embodiment consistent with the present disclosure. The access windows 60 in the top of the left and right hinge boxes LHB and RHB are used for fastening screws into kitchen cabinet attachment brackets of the appliance 100. The small plastic covers 62 are then used to cover or close the access windows 60 when the installation is complete.

FIGS. 11A and 11B show partial front views of another embodiment of the upper plinth or top panel cover 10' which is configured to rotate 180 degrees about a center position for door reversibility with single door appliances according to an exemplary embodiment consistent with the present disclosure. Like elements are denoted by like reference numerals except that they include a prime sign. French door bottom mount appliances (with two fresh food compartment doors) have no need of door reversal, as they are symmetrical left to right. Bottom mount appliances with a single fridge door can be left or right hinged. It is known to make both left and right hinged variants and the customer must buy left or right appliances directly from the factory. This increases the production cost and complicates the supply chain. This also leaves customers in a bad situation if they order an appliance and then decide that it would be more convenient if it was hinged the other way once they see it in their space. For these reasons, it is beneficial to provide a single variant which can be changed to a left or a right hinge at the customer's home.

In particular, FIG. 11B shows a single door fresh food compartment-bottom mount freezer style refrigerator appliance 200 having a single door 202 with a handle 202H and for closing a fresh food compartment 203 and an upper plinth or top panel cover 10'. Since there is only a single right hand door 202 with a right hinge mechanism RHM' and a right hinge box RHB', the left hinge box is removed. The fresh food compartment 203 includes, for example, a shelve S' and a door bin DB' in the door 202. The shelve S' is supported by shelf support railings or shelf support brackets B' that include hooks (not shown) at the rear for connection to and adjustment along vertical tracks V' formed by separate metal strips having openings such as slots or holes O' therein and arranged along a wall (e.g., a rear wall 204 of the refrigerator compartment 203). Although not shown in the FIG. 11B, the single door fresh food compartment-bottom mount freezer style refrigerator appliance 200 can have a bottom freezer compartment which is accessed using a pull out drawer type of configuration.

As shown in FIG. 11B, a circular open door assistant through-hole 70 for an open door assistant ODA is formed in the elongated plate-shaped cover 10A' of the upper plinth or top panel cover 10' for allowing an electrically operated plunger of the ODA to press the door open. The ODA is positioned at the center of the top of the BM appliance. The location of the circular open door assistant through-hole 70 of the upper plinth 10' is set so that door reversal can be accomplished without moving fixed components. FIG. 11B also shows a power switch locator PSL for a left hinge configuration and a portion of the power switch locator PSL for a right hinge configuration. Accordingly, on condition that the elongated plate-shaped cover 10A' is unclipped/detached from the domestic appliance, the elongated plate-shaped cover 10A' is rotated to expose the access area and permit a service technician access to the parts hidden by the upper plinth or top panel cover 10'. A single tether or tie T' can be used to keep the upper plinth or top panel cover 10' from swinging down uncontrollably on one side on condition that the elongated plate-shaped cover 10A' is detached from the domestic appliance 200. Because the upper plinth 10' must be flipped upside down during hinge reversal, only one tether T' is used. The single tether T' can be twisted 180 degrees to allow the upper plinth 10' to be assembled in its alternate orientation. The upper plinth 10' in this embodiment hangs in a less controlled manner from a single tether T' compared to the two tether design of the French door bottom mount appliance 100 described above, but the present configuration still allows easy reversibility without the need to remove and reattach tethers.

As shown in FIG. 11A, if a left hand door with a left hinge mechanism LHM is desired, the right door 202 is removed and the right hinge box RHB is removed. Then the elongated plate-shaped cover 10A' of the upper plinth or top panel cover 10' is turned upside down. The circular open door assistant through-hole 70 remains aligned with the open door assistant ODA plunger and the upper plinth or top panel cover 10' now covers the area that the right hinge box RHB previously occupied.

The present invention has substantial opportunity for variation without departing from the spirit or scope of the present invention. For example, while FIGS. 1 and 2A-2C show a traditional FDBM style refrigerator appliance 100, the present invention can be utilized in single door fresh food compartment-bottom mount BM freezer style refrigerator appliance 200 as shown in FIGS. 11A and 11B, or in FDBM configurations with one or more intermediate compartments (such as, but not limited to, pullout drawers) that can be operated as either fresh food compartments or freezer compartments and which are located between the main fresh food compartment and the main freezer compartment, or in a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, configurations where the entire refrigerator unit is a fresh food compartment from top to bottom without a freezer compartment, or panel front type refrigeration and freezer configurations, and the like.

Moreover, while FIGS. 1, 2A-2C, and 4 show the upper plinth or top panel cover 10 in position on the top of a French door-bottom mount style refrigerator appliance 100 and FIGS. 11A and 11B show the upper plinth or top panel cover 10' in position on the top of a single door fresh food compartment-bottom mount BM freezer style refrigerator 200, the present disclosure also contemplates other configurations such as, but not limited to, integrating the upper plinth or top panel cover 10 into other domestic appliances such as, but not limited to, freezers, ice makers, wine coolers, dishwashers, washing machines, dryers, ovens, and the like.

Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A removable upper plinth or top panel structure for a domestic appliance having a housing, comprising:

an elongated plate-shaped cover for covering an access area at a top portion of the domestic appliance;

a plurality of attachment clips extending rearward from a rear surface of the elongated plate-shaped cover for detachably mounting one or more of various electronic components to the elongated plate-shaped cover and for detachably securing the elongated plate-shaped cover to the housing of the domestic appliance; and a plurality of tethers connected to the domestic appliance and also connected to the elongated plate-shaped cover, such that on condition that the elongated plate-shaped cover is detached from the domestic appliance to expose the access area, the elongated plate-shaped cover flips downward and hangs on the plurality of tethers.

2. The removable upper plinth or top panel structure of claim 1, wherein the plurality of attachment clips includes a projection at a free end thereof for engaging with and affixing the one or more of various components to the elongated plate-shaped cover or engaging with and affixing the elongated plate-shaped cover to the housing of the domestic appliance.

3. The removable upper plinth or top panel structure of claim 2, wherein the projection is hook-shaped.

4. The removable upper plinth or top panel structure of claim 1, wherein the plurality of attachment clips includes a center clip that attaches to a mounting part adapted to be mounted to the housing of the domestic appliance.

5. The removable upper plinth or top panel structure of claim 1, wherein the plurality of attachment clips includes a center clip and left and right side clips.

6. The removable upper plinth or top panel structure of claim 1, further comprising upper and lower gripping jaws on the right and left sides a of the rear surface of the elongated plate-shaped cover that are configured to slide over and grip corresponding posts that extend from right and left hinge boxes of the domestic appliance.

7. The removable upper plinth or top panel structure of claim 6, wherein the configuration of the upper and lower gripping jaws allows for axial sliding movement of the elongated plate-shaped cover in a leftward and a rightward direction relative to the posts and to the domestic appliance to allow for proper alignment of the elongated plate-shaped cover.

8. The removable upper plinth or top panel structure of claim 1, wherein a lower edge of the elongated plate-shaped cover overlaps a front frame of the domestic appliance.

9. The removable upper plinth or top panel structure of claim 1, wherein the elongated plate-shaped cover includes openings for various optional features selected from the group consisting of a power switch, an open door assistant, and a smaller opening for an ambient light sensor.

10. The removable upper plinth or top panel structure of claim 1, wherein the various components are selected from the group consisting of a power switch, an open door assistant, an ambient light sensor, a magnetic reed sensor, and combinations thereof.

11. The removable upper plinth or top panel structure of claim 1, wherein the elongated plate-shaped cover is opaque.

12. A removable upper plinth or top panel structure for a domestic appliance having a housing, comprising:

an elongated plate-shaped cover for covering an access area at a top portion of the domestic appliance;

a plurality of attachment clips extending rearward from a rear surface of the elongated plate-shaped cover for detachably mounting one or more of various electronic components to the elongated plate-shaped cover and for detachably securing the elongated plate-shaped cover to the housing of the domestic appliance; and a single tether to keep the elongated plate-shaped cover from swinging down uncontrollably on one side on condition that the elongated plate-shaped cover is detached from the domestic appliance.

13. The removable upper plinth or top panel structure of claim 12, wherein the single tether can be twisted 180 degrees to allow the elongated plate-shaped cover to be turned upside down and assembled in an alternate orientation.

14. A domestic appliance, comprising:

an outer casing forming a housing;

a front frame disposed on a front portion of the housing;

at least one door mounted to the front portion of the housing; and a removable upper plinth or top panel structure disposed above the front frame on the domestic appliance, the removable upper plinth or top panel structure comprising:

an elongated plate-shaped cover for covering an access area above the front frame of the domestic appliance;

a plurality of attachment clips extending rearward from a rear surface of the elongated plate-shaped cover to detachably mount one or more of various electronic components to the elongated plate-shaped cover and for detachably securing the elongated plate-shaped cover to the housing of the domestic appliance; and at least one tether connected to the domestic appliance and also connected to the elongated plate-shaped cover, such that on condition that the elongated plate-shaped cover is detached from the domestic appliance to expose the access area, the elongated plate-shaped cover is tethered to the domestic appliance by the at least one tether.

15. The domestic appliance of claim 14, wherein the domestic appliance is selected from the group consisting of a French door bottom mount configuration having an upper fresh food compartment with the at least one door comprising two doors and a bottom freezer compartment, and a single door bottom mount configuration having an upper fresh food compartment with the at least one door comprising a single door and a bottom freezer compartment.

16. The domestic appliance of claim 14, wherein the at least one tether comprises a single tether to keep the elongated plate-shaped cover from swinging down uncontrollably on one side on condition that the elongated plate-shaped cover is detached from the domestic appliance.

17. The domestic appliance of claim 14, wherein the at least one tether comprises a plurality of tethers connected to the domestic appliance and also connected to the elongated plate-shaped cover, such that on condition that the elongated plate-shaped cover is detached from the domestic appliance to expose the access area, the elongated plate-shaped cover flips downward and hangs on the plurality of tethers.

18. A removable upper plinth for a domestic appliance, comprising:

an elongated plate-shaped cover for covering an access area at a top portion of the domestic appliance;

a plurality of attachment clips extending rearward from a rear surface of the elongated plate-shaped cover for detachably securing the elongated plate-shaped cover to a housing of the domestic appliance; and at least one tether connected to the domestic appliance and also connected to the elongated plate-shaped cover, such that on condition that the elongated plate-shaped cover is detached from the domestic appliance to expose the access area, the elongated plate-shaped cover is tethered to the domestic appliance by the at least one tether.

19. The removable upper plinth of claim 18, wherein the at least one tether comprises a single tether to keep the elongated plate-shaped cover from swinging down uncontrollably on one side on condition that the elongated plate-shaped cover is detached from the domestic appliance.

20. The removable upper plinth of claim 18, wherein the at least one tether comprises a plurality of tethers connected to the domestic appliance and also connected to the elongated plate-shaped cover, such that on condition that the elongated plate-shaped cover is detached from the domestic appliance to expose the access area, the elongated plate-shaped cover flips downward and hangs on the plurality of tethers.

* * * * *